United States Patent [19]

Gevatter et al.

[11] Patent Number: 4,521,257

[45] Date of Patent: Jun. 4, 1985

[54] PROCESS OF MANUFACTURING STRIP COATED WITH PRECIOUS METAL AS A SEMIFINISHED PRODUCT FOR MAKING ELECTRIC CONTACTS

[75] Inventors: Hans-Jürgen Gevatter, Heidelberg; Bernhard Müller, Keltern-Ellmendingen; Hans-Joachim Neese, Eisingen, all of Fed. Rep. of Germany

[73] Assignee: Doduco KG Dr. Eugen Durrwachter, Pforzheim, Fed. Rep. of Germany

[21] Appl. No.: 468,661

[22] Filed: Feb. 22, 1983

[30] Foreign Application Priority Data

Feb. 20, 1982 [DE] Fed. Rep. of Germany ..... 3206262

[51] Int. Cl.[3] ..... C25D 5/50; C25D 7/06; B41B 3/00

[52] U.S. Cl. ..... 148/11.5 Q; 204/15; 204/28; 204/35.1; 204/37.1; 204/38.4; 427/90; 427/250; 427/258; 427/365; 427/383.7

[58] Field of Search ..... 204/15, 37 R, 37 T, 204/36, 35 R, 28, 38 B, 40; 427/360, 365, 366, 90, 250, 258, 383.7; 148/11.5 Q, 127, 130; 72/47

[56] References Cited

U.S. PATENT DOCUMENTS

| | | | |
|---|---|---|---|
| 3,147,547 | 9/1964 | Kuebrich et al. | 29/528 |
| 3,867,212 | 2/1975 | Dromsky | 148/127 |
| 3,921,886 | 11/1975 | Ford et al. | 228/117 |
| 4,287,009 | 9/1981 | Allegra et al. | 148/127 |
| 4,309,461 | 1/1982 | Shibata | 427/259 |
| 4,349,585 | 9/1982 | Nagashima | 427/125 |

*Primary Examiner*—G. L. Kaplan
*Assistant Examiner*—W. T. Leader
*Attorney, Agent, or Firm*—Balogh, Osann, Kramer, Dvorak, Genova & Traub

[57] ABSTRACT

A process is described for the manufacture of strip comprising a base metal substrate, a coating which has been electrodeposited on selected surface portions of said substrate and consists of precious metal or a precious metal alloy and, if desired, an intermediate diffusion barrier layer consisting particularly of nickel. The resulting strip constitutes a semifinished product for use in the making of electric contacts. When the coating has been electrodeposited, the strip is subjected to a recrystallizing annealing and to a rolling operation, preferably a cold-rolling operation.

18 Claims, No Drawings

PROCESS OF MANUFACTURING STRIP COATED WITH PRECIOUS METAL AS A SEMIFINISHED PRODUCT FOR MAKING ELECTRIC CONTACTS

This invention relates to a process of manufacturing strip which comprises a base metal substrate, an electrodeposited coating of precious metal or a precious metal alloy on selected surface portions of the substrate, and a diffusion barrier layer disposed between the substrate and coating and consisting preferably of nickel. Said strip can be used as a semifinished product in the manufacture of electric contacts.

It is known that strip comprising a base metal substrate consisting, e.g., of copper, brass, bronze, German silver or other metallic materials which can be used as substrates for electric contacts can be electroplated with a precious metal or a precious metal alloy consisting in most cases of pure gold or a high-gold alloy. In order to save precious metal. the coating is selectively applied either throughout the surface of the strip only on one side thereof or in the form of stripes or spots on the substrate strip.

It is also known that prepunched strip can be electroplated. Such strips have punched apertures in regions which would be removed in any case in the manufacture of electrical contacts from the strip. Part of said regions are removed from the strip by punching before the electroplating operation. Precious metal cannot be deposited on the areas from which the base metal has been removed by punching, but precious metal can deposit on the cut edges defining the punched apertures. In this manner the quality of the precious metal coating, particularly its bond strength, can be improved.

The substrate strip carrying the precious metal coating has usually a high copper content. At elevated temperatures, e.g., during switching operations, copper tends to diffuse through coatings of precious metals, such as gold or silver or their alloys, to the surface of the precious metal coating and to form copper oxide there, which increases the contact resistance. On the other hand, the precious metals tend to diffuse into the substrate. In order to resist such diffusion, it is known to provide in multi-layered contacts a diffusion barrier between the precious metal coating and the substrate. The diffusion barrier consists in most cases of a thin interlayer of nickel although the use of interlayers of other materials, such as chromium and cobalt, has also been investigated. Such intermediate diffusion barrier layer may cover the substrate strip entirely and covers it at least in the regions in which the precious metal coating is to be applied. The interlayer may be applied by electrodeposition.

Discrete contact elements are made from the electroplated strip by stamping and bending operations. But the electrodeposited coatings, particularly the intermediate diffusion barrier layers, are rather brittle and owing to their low ductility tend to become torn or even to peel from the substrate during the stamping and bending operations which are required. Besides, electrodeposited precious metal coatings have a lower abrasion resistance than precious metal coatings which have been welded to a base metal substrate by hot or cold roll cladding. In multi-layer contact strips made by such methods the cladding has a sufficiently high ductility and abrasion resistance, but owing to the large deformation effected by the rolling process exhibits considerable variations in thickness and possibly also in width and as regards its position on the substrate strip. These variations must be allowed for in the selection of the dimensions of the precious metal cladding so that the same must have a relatively large thickness and width, which must distinctly exceed the corresponding dimensions required for an electrodeposited precious metal coating. This means that the manufacture of multi-layered contact strips by roll cladding requires more precious metal than the manufacture of such strips by electrodeposition.

It is an object of the invention to provide for the manufacture of multi-layered contact strip a highly economical process which results in such strip in which the precious metal coatings have a high bond strength, a high ductility and a high abrasion resistance and a highly constant thickness and width.

This object is accomplished in that the electroplated strip is subjected to a heat treatment resulting in a recrystallization of the electrodeposited layers and of the substrate base material, and after said heat treatment is subjected to a rolling operation in which the electroplated strip is shaped to its final size by a reduction in thickness of 10 to 50% of the original thickness of the electroplated strip.

Additional features of the invention are recited in the dependent claims.

The combination of a heat treatment and of a rolling operation has the result that the intermediate diffusion barrier layer and the precious metal coating have such a high ductility that the quality of the coating will not be adversely affected by stamping and bending operations usually required to make finished contact elements from the strip. Besides, the precious metal coating is strengthened and exhibits less wear during switching operations than an electrodeposited precious metal coating which has the same composition and has not been subjected to a heat treatment and a rolling operation. It has also been found that the strengths of the bonds between the precious metal coating and the interlayer and between the latter and the substrate strip are distinctly increased by the heat treatment and the rolling operation.

By the use of the method of the invention in the manufacture of multi-layered strip for making contacts, the advantages afforded by roll cladding (high bond strength and high ductility of the coatings) and those afforded by the electrodeposition of the coatings (high dimensional accuracy, uniform thicknesses of the layer, low consumption of precious metal, possibility to apply the coatings in virtually any desired pattern on strip having any desired length) are obtained in combination. The desirable results produced by the process according to the invention are particularly significant in the manufacture of strip having coatings of gold or gold alloys on a nickel interlayer.

The method according to the invention is carried out in such a manner that the strip carrying the electrodeposited coatings is first heat-treated and then cold-rolled.

The reduction which is to be effected by the rolling operation depends on the composition and structure of the precious metal coating, on the nature of the intermediate layer and on the desired strengthening of the precious metal coating. the interlayer and the substrate material. The reduction of the thickness of the strip relative to its thickness before the beginning of the deformation should be between 10% and 50%, preferably between 20% and 40%. That reduction may be achieved by a single rolling pass and is preferably effected by three or four rolling passes, preferably by cold rolling without annealing between successive passes.

The temperatures and the time of the heat treatment are not selected independently of each other but are so selected that the desired increase of ductility is achieved within a reasonable time of about 5 minutes to 15 minutes. The higher the temperature which is selected, the shorter may be the treatment time. The upper temperature limit is so selected that the action of the temperature of the surrounding fluid does not deteriorate the substrate strip or the precious metal coating.

If the coating consists of one of the most widely used precious metals, such as pure gold, a gold alloy, silver, a palladium alloy, the heat treatment is preferably carried out at a temperature between 400° and 750° C., particularly between 550° and 650° C., unless a lower temperature is required in view of the nature of the base metal substrate.

The electrodeposited interlayer is preferably pretreated jointly with the precious metal coating by the action of heat and a rolling operation, preferably a cold-rolling operation. Alternatively, the interlayer may be subjected to a heat treatment and, if desired, to a rolling operation before the precious metal coating is applied. During such separate heat treatment the nickel layer may be subjected to a higher temperature than is permissible for the precious metal coating if this is permissible in view of the substrate material. In that case the ductility of the nickel layer can be increased to a higher value than by a heat treatment of the nickel layer only jointly with the precious metal coating.

The process according to the invention can also be used to advantage in the manufacture of strip which carries an electrodeposited precious metal coating and in which the manufacture of strip which comprises an intermediate diffusion barrier layer, particularly of nickel, which has been applied to the substrate strip by cold or hot roll cladding so that only the precious metal coating is applied by electrodeposition. In such cases the use of the process will increase the strength and ductility of the precious metal coating and its bond strength and abrasion resistance and will result in a substantial saving of precious metal.

A special advantage afforded by the invention resides in that it can be used to apply precious metal coating of alloys which cannot be electro-deposited or can be electrodeposited only with difficulty from a bath. This is particularly applicable to low-gold alloys. According to a further feature of the invention the alloying elements are deposited in superimposed layers and are caused to diffuse into each other by the subsequent heat treatment so that an alloy is formed. In order to minimize the time required for the formation of the alloy, it may be desirable to apply each alloying element in a plurality of layers in alternation with layers consisting of respective other alloying elements so that the diffusion paths are shortened.

The process taught by the invention for the aftertreatment of electrodeposited precious metal coatings in the manufacture of laminated contact strips can also be used for an aftertreatment of precious metal coatings which have been deposited from the gas phase, preferably by vapor deposition.

Some Examples of the process according to the invention will now be described.

EXAMPLE 1

A longitudinal stripe of nickel in a thickness of 3 microns was electrodeposited on a substrate strip consisting of CuSn-6 bronze and having a thickness of 0.55 mm. A stripe of pure gold was electrodeposited in a thickness of 2 microns and a width of 3 mm on the nickel stripe. The resulting laminated strip was subsequently annealed at a temperature of about 600° C. for about 5 minutes and after that heat treatment was cold-rolled to a final thickness of 0.4 mm in four rolling passes, the fourth of which effected the smallest reduction of the strip.

EXAMPLE 2

A longitudinal stripe of nickel in a width of 4 mm and a thickness of 5 microns was electrodeposited on one side of a substrate strip of CuNi9Sn2 having a thickness of 0.7 mm. The nickel-plated strip was then annealed at a temperature of about 650° C. for about 5 minutes. After that heat treatment, the strip was cold-rolled to a thickness of 0.55 mm in three passes.

A layer consisting of the alloy Au80Ag20 was applied from a bath to the pretreated strip to form on the nickel layer a stripe which was 3 mm wide. The resulting strip was annealed at a temperature of about 630° C. for about 8 minutes. After that heat treatment, the strip was cold-rolled to a final thickness of 0.4 millimeter as in Example 1.

EXAMPLE 3

A nickel layer was first electrodeposited in the form of a stripe 3 mm wide and 3 microns thick on a substrate strip consisting of German silver CuNi12Zn24 and having a thickness of 0.4 mm. To form a precious metal coating consisting of 70% by weight gold, 25% by weight silver and 5% by weight copper. the required quantities of gold, silver and copper, respectively, were electrodeposited in separate superimposed layers on the nickel layer to form a stripe having a width of 2 mm. The first layer applied to the nickel layer consisted of silver and was succeeded by gold, copper, silver, gold, copper layers and by a top layer of gold. The resulting strip was then annealed at about 630° for about 8 minutes so that the components of the sandwich structure were caused to diffuse into each other so as to form a homogeneous Au-Ag-Cu alloy. The strip was finally cold-rolled to a final thickness of 0.3 mm in 3 passes.

EXAMPLES 3 to 6

To make a nickel-plated substrate strip, a narrow, elongated slab of silver-bronze CuAg2 was provided in a thickness of 30 mm. A groove in a depth of 0.5 mm was milled into said slab and a strip of nickel in a thickness of 0.5 mm was laid into said groove. The slab was then shaped to a strip having a thickness of 0.55 mm by hot roll cladding. That strip was provided with a precious metal coating and aftertreated by the steps disclosed in each of Examples 1 to 3.

EXAMPLES 7 to 18

Examples 1 to 6 were repeated but the interlayer of nickel was replaced by an interlayer of cobalt or chromiun.

EXAMPLE 19

A strip of OFHC copper in a thickness of 0.7 mm was provided by roll cladding with an inlaid stripe of silver in a width of 3 mm and a thickness of 225 microns A pure gold layer in a thickness of 8 microns was electrodeposited on the silver inlay. The strip was then annealed at a temperature of about 560° C. for 5 minutes and was subsequently cold-rolled to the final size in four passes effecting a reduction of 30% based on the initial thickness of the strip without an annealing between successive passes.

What is claimed is:

1. The method of manufacturing a semi-finished coated strip material to be used for manufacturing electrical contacts, the strip comprising a base metal substrate made of copper or a copper alloy, a surface layer made of precious metal or a precious metal alloy on selected portion of the substrate and an intermediate layer consisting of a base metal forming a diffusion barrier therebetween, comprising the steps of depositing said intermediate layer on said substrate strip, electro-despositing said surface layer on said selected portions of the substrate strip above said intermediate layer, subjecting the coated strip to at least one heat treatment resulting in a recrystallization of said substrate, said intermediate layer and said surface layer, and cold-rolling the coated strip so that its thickness is reduced by 10 to 50 percent of the thickness it had before the rolling operation.

2. The method set forth in claim 1, wherein said heat treatment is carried out at a temperature between 400° and 750° C. for 5 to 15 minutes.

3. The method set forth in claim 2, wherein said heat treatment is carried out at a temperature between 550° and 650° C.

4. The method set forth in claim 1, wherein said rolling operation consists of three to four passes.

5. The method set forth in claim 4, wherein no annealing is performed between successive rolling passes.

6. The method set forth in claim 1, wherein said rolling operation effects a reduction of the thickness of said coated strip by 20 to 40% of the thickness it had before said rolling operation.

7. The method set forth in claim 1, wherein said coated strip is subjected to a single heat treatment resulting in a recrystallization of said substrate, said intermediate layer and said surface layer.

8. The method set forth in claim 1, wherein the intermediate layer is applied by electro-desposition.

9. The method set forth in claim 8, wherein said intermediate layer on said substrate is subjected to a separate heat treatment before said surface layer is electrodeposited on said intermediate layer.

10. The method set forth in claim 9, wherein said intermediate layer on said substrate is subjected to a separate heat treatment resulting in a recrystallization of said intermediate layer before said surface layer is electrodeposited on said intermediate layer.

11. The method set forth in claim 9, wherein said substrate and said intermediate layer electrodeposited on said substrate are subjected to a separate rolling operation to effect a reduction of the total thickness of the substrate and intermediate layer by 10 to 50% of the total thickness they had before said separate rolling operation, and said surface layer is electrodeposited on said intermediate layer after said separate rolling operation.

12. The method set forth in claim 11, wherein said separate rolling operation effects a reduction of the total thickness of the substrate and intermediate layer by about 30% of the total thickness they had before said separate rolling operation.

13. The method set forth in claim 1, wherein said intermediate layer consists of a metal selected from the class consisting of nickel, cobalt, and mixtures thereof and said intermediate layer is subjected to a heat treatment of 550° to 650° C. before said surface layer is electrodeposited thereon.

14. The method set forth in claim 1 as applied to a process in which said intermediate layer is applied by roll cladding.

15. The method set forth in claim 1, wherein said surface layer consists of a plurality of alloying elements, said alloying elements are electrodeposited on said substrate in superimposed layers consisting of respective alloying elements and said separate layers are subjected to a heat treatment resulting in a diffusion of said alloying elements into each other.

16. The method set forth in claim 15, wherein said alloying elements are unsuitable for joint electrodeposition from a single bath.

17. The method set forth in claim 1, wherein said rolling operation effects a reduction of the thickness by about 30% of the thickness it had before said rolling operation.

18. The method of manufacturing a semi-finished, coated strip material to be used for manufacturing electrical contacts, the strip comprising a base metal substrate made of copper or a copper alloy, a surface layer made of precious metal or a precious metal alloy on selected portions of the substrate and an intermediate layer consisting of a base metal forming a diffusion barrier therebetween, comprising the steps of depositing said intermediate layer on said substrate strip, depositing said surface layer on said selected portions of the substrate strip above said intermediate layer from a gas phase, subjecting the coated strip to at least one heat treatment resulting in a recrystallization of said substrate, said intermediate layer and said surface layer, and cold-rolling the coated strip so that its thickness is reduced by 10 to 50 percent of the thickness it had before the rolling operation.

* * * * *